US005177879A

United States Patent [19]

Muta

[11] Patent Number: 5,177,879

[45] Date of Patent: Jan. 12, 1993

[54] HAIR DRYER APPARATUS

[76] Inventor: David J. Muta, 8998 S.W. Leahy Rd., Portland, Oreg. 97225

[21] Appl. No.: 835,364

[22] Filed: Feb. 14, 1992

[51] Int. Cl.[5] ..... A45D 20/00

[52] U.S. Cl. ..... 34/97; 34/90; 392/381

[58] Field of Search ..... 34/90, 91, 96, 97, 98, 34/202; 392/380, 381, 382, 363, 370; 248/314

[56] References Cited

U.S. PATENT DOCUMENTS 3,272,966 9/1966 Sutton ..... 34/96
4,195,416 4/1980 Hall ..... 34/90
4,659,907 4/1987 Andis et al. ..... 248/674
4,735,002 4/1988 Rath ..... 34/97
4,754,769 7/1988 Flynn ..... 34/202
4,785,162 11/1988 Kuo ..... 34/96
4,802,287 2/1989 Chen ..... 34/97

*Primary Examiner*—Henry A. Bennet
*Assistant Examiner*—Denise L. F. Gromada
*Attorney, Agent, or Firm*—Leon Gilden

[57] ABSTRACT

A hair dryer apparatus is arranged to include a portably mounted hair dryer assembly secured to a housing, with the housing including an air directing conduit directed therethrough for selective securement of a hand supported plate assembly permitting ease of drying of fingernail polish and the like, and a support plate for securing various garments thereto such as hosiery.

2 Claims, 4 Drawing Sheets

FIG. 6
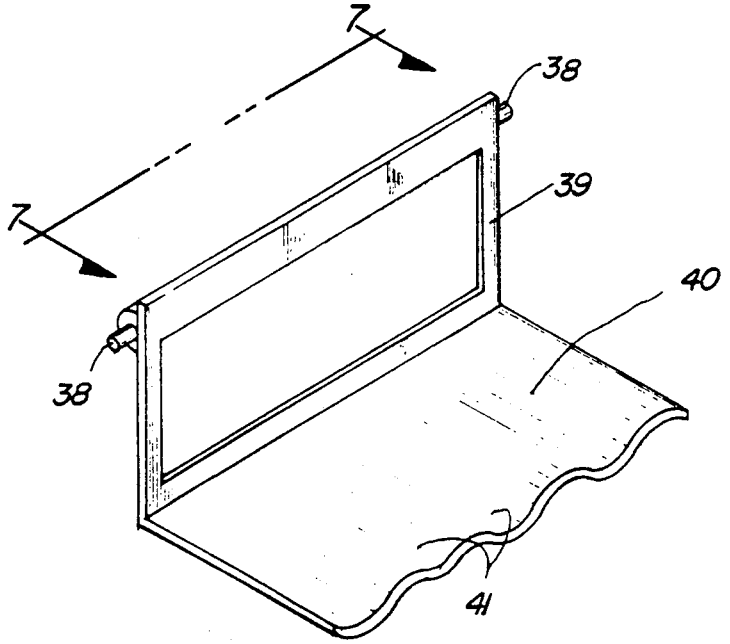
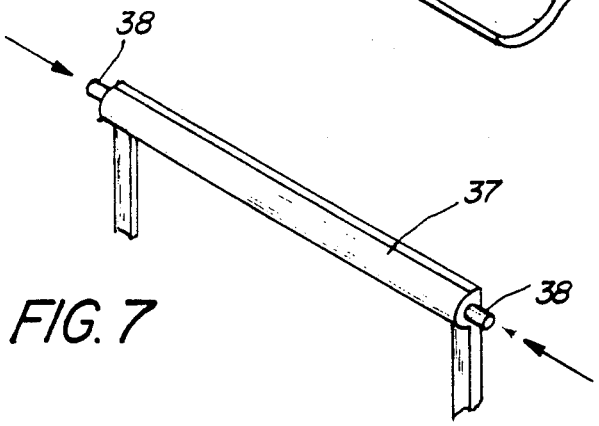
FIG. 7
FIG. 8
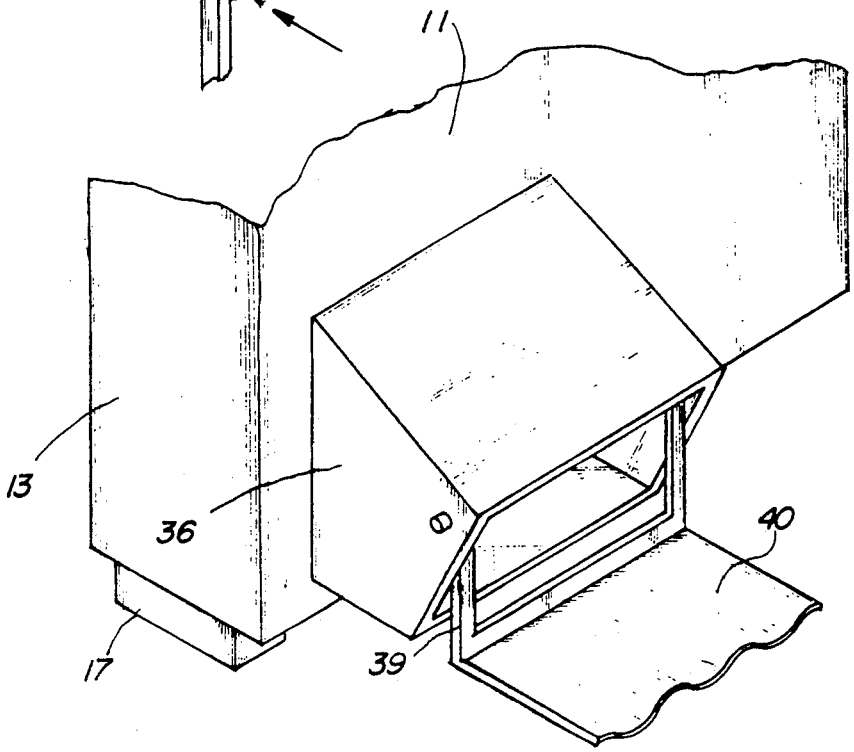

HAIR DRYER APPARATUS

BACKGROUND OF THE INVENTION

1. Field of the Invention

The field of invention relates to hair dryer apparatus, and more particularly pertains to a new and improved hair dryer apparatus wherein the same is arranged for the selective utilization of the structure for a hair drying, fingernail drying, or garment drying organization.

2. Description of the Prior Art

Prior art structure has been utilized for the use of a hair dryer structure to include a portably oriented hair dryer member for access by individuals to the drying of hair. Such hair drying structure typically utilizes heating coils and the like therewithin and are exemplified in the U.S. Pat. Nos. 4,214,149 and 4,827,105.

Hair dryer support structure is exemplified in the U.S. Pat. Nos. 4,874,142 and 4,696,447 setting forth loop members for support of hair dryer assembly therewithin.

As such, it may be appreciated there continues to be a need for a new and improved hair dryer apparatus as set forth by the instant invention which addresses both the problems of ease of use as well as effectiveness in construction in accommodating the use of the structure for hair drying as well as garment and fingernail drying in a selective manner and in this respect, the present invention substantially fulfills this need.

SUMMARY OF THE INVENTION

In view of the foregoing disadvantages inherent in the known types of hair dryer apparatus now present in the prior art, the present invention provides a hair dryer apparatus wherein the same utilizes housing assemblies to support a hair dryer member thereon. As such, the general purpose of the present invention, which will be described subsequently in greater detail, is to provide a new and improved hair dryer apparatus which has all the advantages of the prior art hair dryer apparatus and none of the disadvantages.

To attain this, the present invention provides a hair dryer apparatus arranged to include a portably mounted hair dryer assembly secured to a housing, with the housing including an air directing conduit directed therethrough for selective securement of a hand supported plate assembly permitting ease of drying of fingernail polish and the like, and a support plate for securing various garments thereto such as hosiery.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair dryer apparatus which has all the advantages of the prior art hair dryer apparatus and none of the disadvantages.

It is another object of the present invention to provide a new and improved hair dryer apparatus which may be easily and efficiently manufactured and marketed.

It is a further object of the present invention to provide a new and improved hair dryer apparatus which is of a durable and reliable construction.

An even further object of the present invention is to provide a new and improved hair dryer apparatus which is susceptible of a low cost of manufacture with regard to both materials and labor, and which accordingly is then susceptible of low prices of sale to the consuming public, thereby making such hair dryer apparatus economically available to the buying public.

Still yet another object of the present invention is to provide a new and improved hair dryer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of the fingernail support assembly of the invention.

FIG. 7 is an orthographic view, taken along the lines 7—7 of FIG. 6 in the direction indicated by the arrows.

FIG. 8 is an isometric illustration of the fingernail support assembly mounted to the air flow conduit outlet tube.

DESCRIPTION OF THE PREFERRED EMBODIMENT

Figure 1:
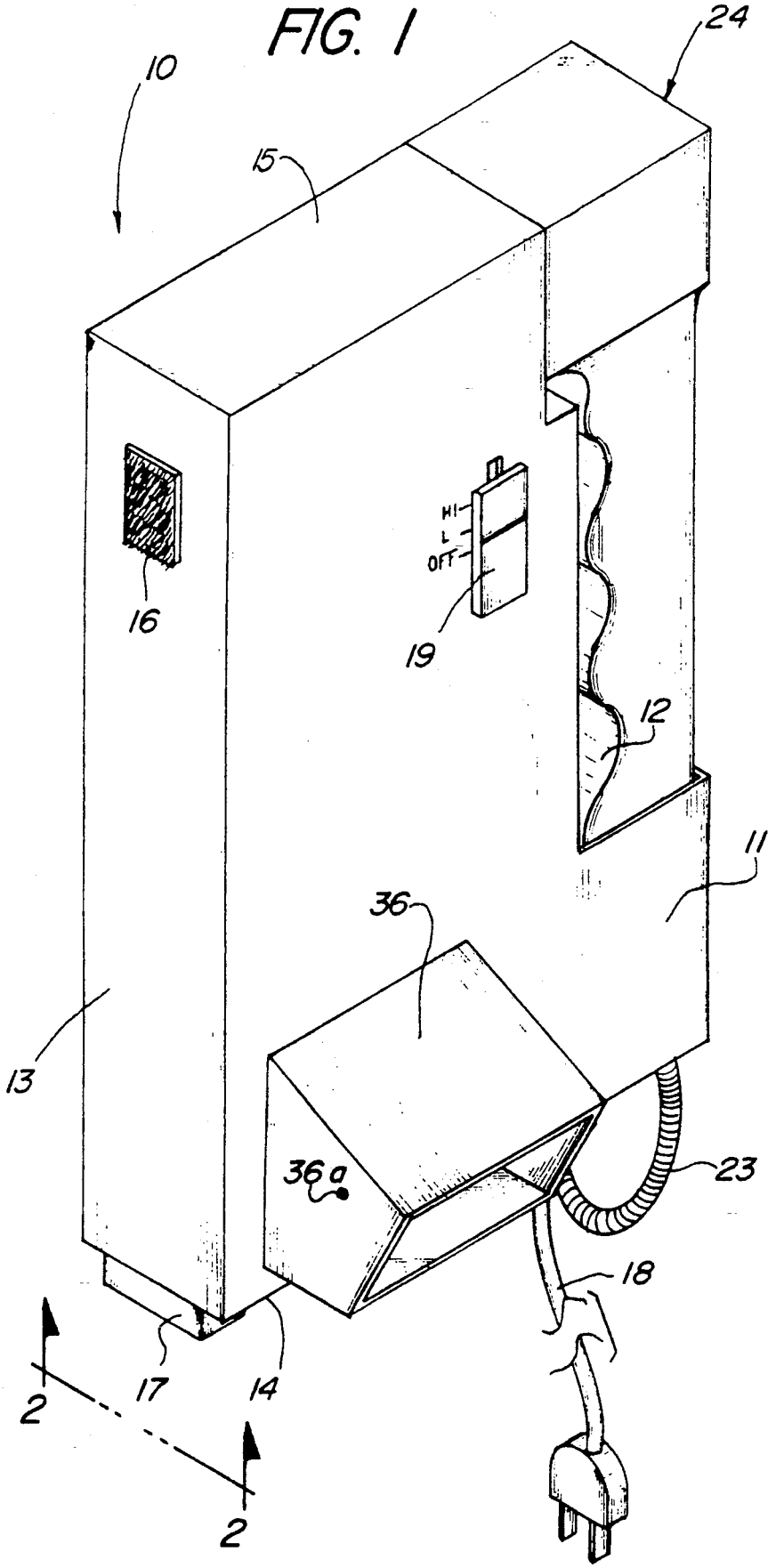
FIG. 1 is an isometric illustration of the instant invention.
Figure 2:
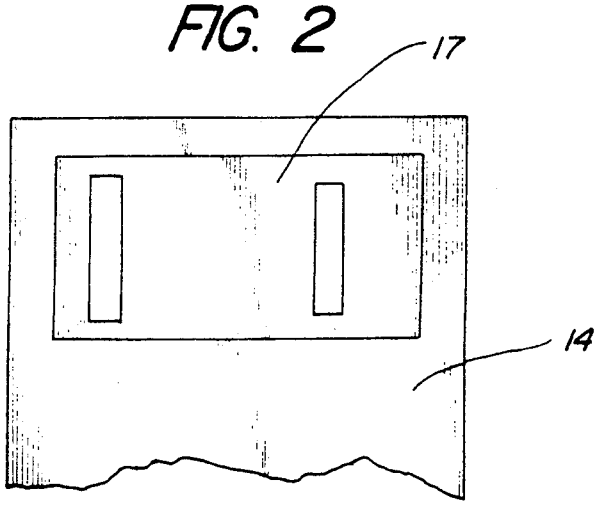
FIG. 2 is an orthographic view, taken along the lines 2—2 of FIG. 1 in the direction indicated by the arrows.
Figure 3:
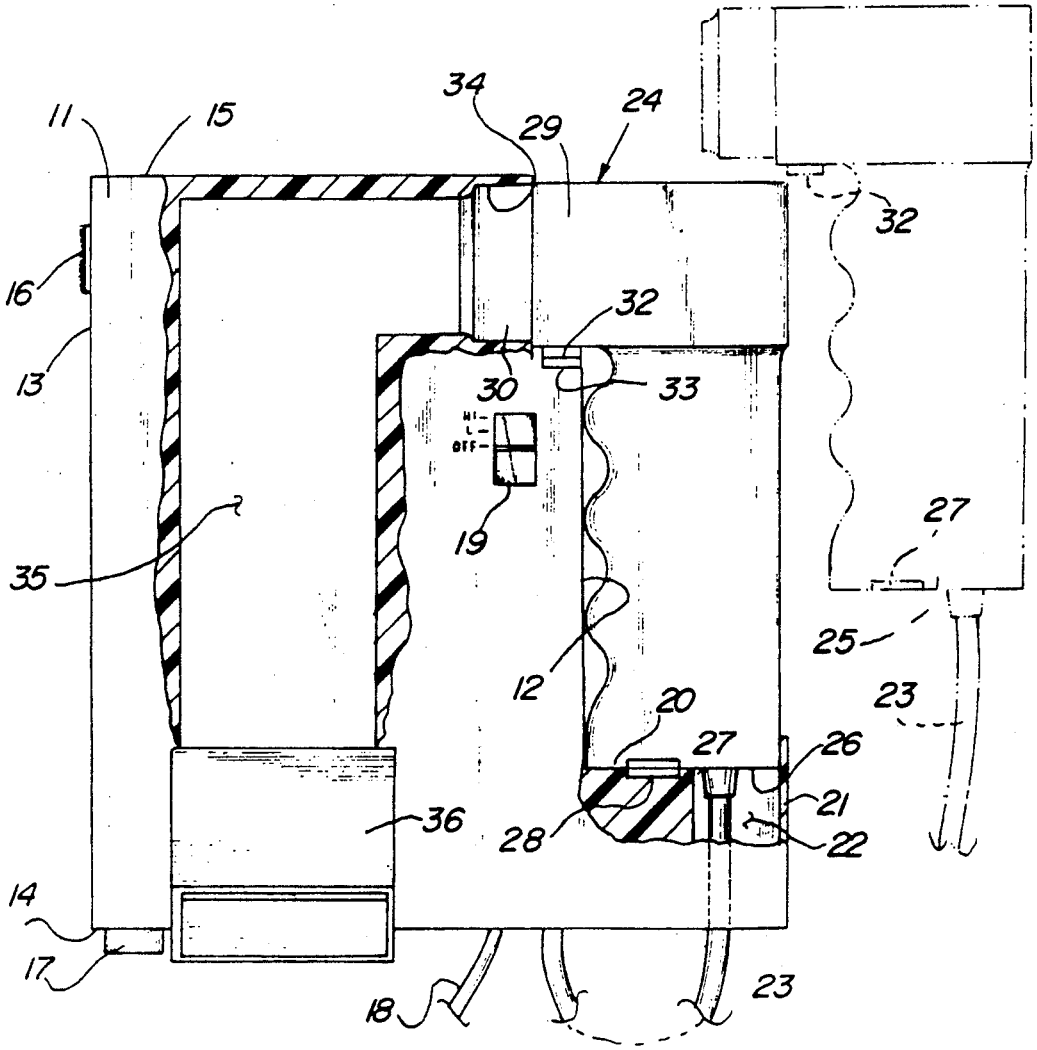
FIG. 3 is an orthographic frontal view, partially in section, of the invention.

With reference now to the drawings, and in particular to FIGS. 1 to 8 thereof, a new and improved hair dryer apparatus embodying the principles and concepts of the present invention and generally designated by the reference numeral 10 will be described.

More specifically, the hair dryer apparatus 10 of the instant invention essentially comprises a housing, including a housing front wall 11, a housing right side wall 12 spaced from a housing left side wall 13. A housing bottom wall 14 is spaced from the housing top wall 15. A hook and loop fastener patch 16 is secured to the left side wall 13 adjacent the top wall 15 for permitting mounting of an electric razor thereto, of a conventional type not shown, where it is understood that an equivalent hook and loop fastener patch would be secured to the razor body for mounting to the patch 16. To this end, an electrical outlet 17 is secured to the bottom wall 14 that in turn is in electrical communication with an electrical power supply cord 18. A support wall 20 (see FIG. 3) is integrally and orthogonally mounted to the right wall 12 spaced above the bottom wall 14. An abutment wall 21 orthogonally oriented relative to the support wall 20 is spaced therefrom and extends from the bottom wall 14 to an orientation above the support wall 20 to define an electrical power cord receiving conduit 22 therebetween the abutment wall 21 and the support wall 20, with the electrical power cord 23 directed to a hair dryer member 24 that in turn is in electrical communication with the power supply 18. An electrical power cord 23 is directed to a hair dryer member 24 of a type utilizing internal heating coil exemplified but not limited by the U.S. Pat. No. 4,214,149 incorporated herein by reference. The hair dryer member 24 includes a handle 25, with the handle 25 including a handle bottom wall 26 formed with a first magnet 27 secured thereto magnetically attracted to a first ferrous plate 28 secured to the support wall 20. A hair dryer head 29 mounted to an upper distal end of the handle 25 includes an outlet nozzle 30, with a head bottom wall 31 mounting a second magnet 32 adherable to a second ferrous plate 33 secured adjacent an upper distal end of the right side wall 12 to provide for secure adherence of the hair dryer relative to the housing. In this manner, the nozzle 30 is received within a nozzle receiving conduit 34 projecting in a parallel relationship relative to the top wall within the housing, with a conduit 35 from the nozzle receiving conduit 34 in a parallel relationship relative to the left side wall 13 to a conduit outlet tube 36 directed through and projecting from the front wall 11. The outlet tube 36 includes a plurality of spaced bores 36*a* to accommodate a garment and the like thereabout such as hosiery.

To permit additional means of securing hosiery, and as well as supporting an individual's hand in orientation relative to the outlet tube 36, a support tube 37 (see FIGS. 6 and 7) includes a plurality of retractable pins 38 coaxially aligned at each distal end of the support tube 37, with the retractable pins 38 projecting through the bores 36*a* (see FIG. 8). A support tube frame 39 is fixedly mounted in an orthogonal relationship downwardly relative to the support tube 37, including a frame undulating plate 40 orthogonally and integrally mounted to a lower distal end of the support tube frame 39, including spaced parallel grooves 41 to provide for finger receiving grooves for a hair dryer positioned in an individual's hand in a fingernail drying procedure. Further, the undulating plate 40 permits enhanced ease of securing a garment or positioning a garment thereon in alignment with the outlet tube 36.

Figure 4:
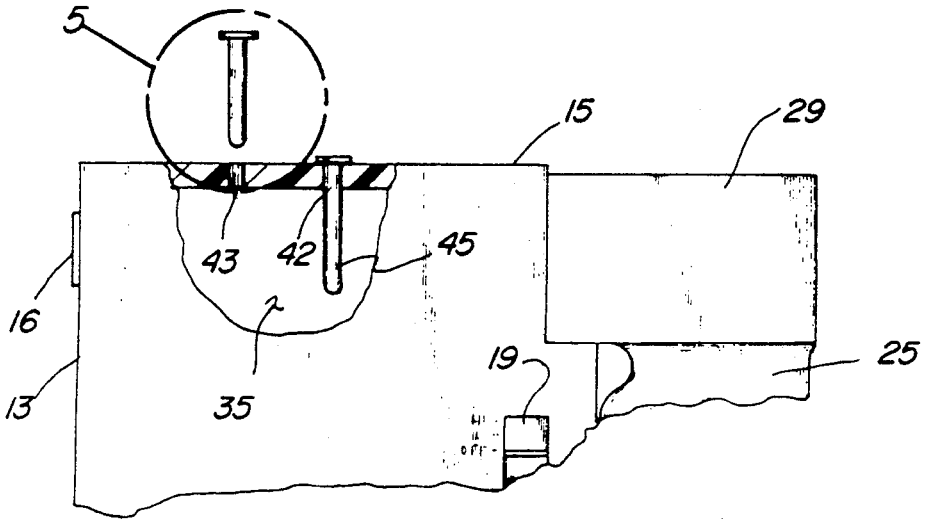
FIG. 4 is an enlarged orthographic view, partially in section, of a modified top wall of the invention.
Figure 5:
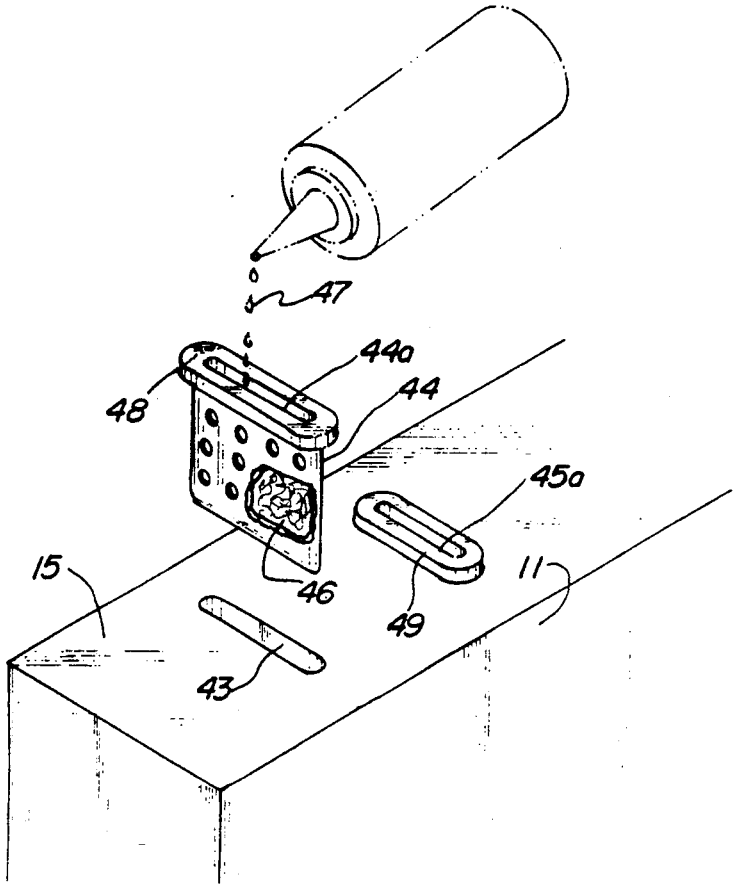
FIG. 5 is an isometric illustration of the pouch members arranged for reception within the top wall.

The reference to FIGS. 4 and 5 illustrates the top wall 15 including a plurality of slots defining a first and second top wall slot 42 and 43 respectively receiving a respective first and second apertured pouch 44 and 45 respectively. The pouches 44 and 45 include respective first and second pouch entrances 44*a* and 45*a* to receive a fluid therewithin, wherein the first pouch is arranged to receive an aromatic fluid selectively with the second pouch arranged to receive a bactericide therewithin to be directed into the air flow through the air flow conduit 35 from the nozzle receiving conduit 34. Apertured pouch 44 and 45 include a fibrous wadding 46 contained therewithin to provide for fluid absorption of the fluid 47 directed therein. A first pouch flange 48 and a second pouch flange 49 are respectively and integrally mounted to upper distal ends of the first and second pouches 44 and 45 for projection beyond the pouches for abutment to the top wall of the housing to provide for proper orientation of each pouch within the air flow conduit 35, in a manner as illustrated in FIG. 4.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as being new and desired to be protected by Letters Patent of the United States is as follows:

1. A hair dryer apparatus, comprising, a housing, the housing including a front wall, a bottom wall spaced from a top wall, and a right side wall spaced from a left side wall, and an electric power supply directed into the housing, and an electrical outlet receptacle mounted to the bottom wall, and a support wall fixedly and orthogonally mounted to the right side wall spaced above the bottom wall, and an abutment wall fixedly mounted to the bottom wall extending orthogonally relative to the bottom wall to an orientation above the support wall, with an electrical power cord receiving conduit directed between the support wall and the abutment wall, and a hair dryer member, the hair dryer member including an electric power cord directed through the electric power cord receiving conduit in electrical communication with the electric power supply, and the hair dryer member including a handle, the handle securable to the support wall in contiguous communication with the abutment wall when mounted adjacent the right side wall, with the hair dryer member further including a hair dryer head arranged for projection to the housing, and the handle includes a handle bottom wall, the handle bottom wall includes a first magnet, and the support wall includes a ferrous plate magnetically adherable to the first magnet, and the hair dryer head includes a hair dryer head bottom wall, with the hair dryer head bottom wall including a second magnet, and a second ferrous plate mounted within the housing adjacent the right side wall aligned with the second magnet when the hair dryer member is secured to the housing, and the housing includes a nozzle receiving conduit directed into the housing between the right side wall and the top wall, and an air flow conduit directed through the housing in pneumatic communication with the nozzle receiving conduit, with the air flow conduit directed into a conduit outlet tube. the conduit outlet tube projecting and canted downwardly relative to the front wall, and the conduit outlet tube includes a plurality of spaced, coaxially aligned bores, and a support tube, the support tube including a plurality of rotatable pins projecting from the support tube at opposed ends of the support tube, with each of the retractable pins directed through one of said bores, and a support tube frame fixedly mounted to the support tube, and an undulating plate fixedly and orthogonally mounted to a lower distal end of the support tube frame, with the undulating plate including a plurality of spaced parallel finger supporting grooves.

2. An apparatus as set forth in claim 1 wherein the top wall includes at least one slot directed through the top wall in communication with the air flow conduit, and an apertured pouch arranged for reception within the slot, the apertured pouch including an apertured pouch flange fixedly mounted at an upper distal end of the apertured pouch, and the apertured pouch including a fibrous wadding contained therewithin, and the wadding arranged for reception of fluid for aromatic infusion of the fluid into air flow through the air flow conduit.

* * * * *